United States Patent [19]

Amador

[11] Patent Number: 4,461,369

[45] Date of Patent: Jul. 24, 1984

[54] ARTICULATED BOOM AND ASSEMBLY THEREFOR

[75] Inventor: Joseph Amador, Brampton, Canada

[73] Assignee: Amador Hydraulic Services Limited, Brampton, Canada

[21] Appl. No.: 248,960

[22] Filed: Mar. 30, 1981

[51] Int. Cl.[3] ..... B66F 11/04

[52] U.S. Cl. ..... 182/2; 212/261; 212/266; 212/233

[58] Field of Search ..... 182/2; 212/260, 261, 212/269, 233, 238, 266; 52/116, 120; 248/654, 653, 652

[56] References Cited

U.S. PATENT DOCUMENTS

| | | | |
|---|---|---|---|
| 3,042,236 | 7/1962 | Pilch | 212/238 |
| 3,085,648 | 4/1963 | Benedetto | 182/2 |
| 3,262,517 | 7/1966 | Malee | 182/2 |
| 3,298,539 | 1/1967 | Sundstrom | 212/238 |
| 3,411,606 | 11/1968 | Oldakowski | 182/2 |
| 3,741,143 | 6/1973 | McKinley | 182/2 |
| 3,848,699 | 11/1974 | Goodwin | 182/24 |
| 4,085,853 | 4/1978 | Lely | 212/260 |
| 4,179,010 | 12/1979 | Ashworth | 182/2 |

*Primary Examiner*—Reinaldo P. Machado
*Attorney, Agent, or Firm*—Ivor Hughes

[57] ABSTRACT

An articulated boom and assembly comprising:

(a) a lower boom arm;

(b) an upper boom arm foldable over the lower boom arm and pivotal with respect to the lower boom arm;

(c) hydraulic cylinders positioned between the boom arms and having piston rods extending therefrom, the hydraulic cylinders with the piston rods, pivotally secured at one end to each boom arm intermediate the boom arm's ends, one hydraulic cylinder being pivotally secured to the underside of the upper arm and the other cylinder pivotally secured to the upper side of the lower arm facing the upper side when the upper arm is folded over the lower arm;

(d) a linkage for pivotally connecting the upper arm, lower arm and hydraulic cylinders, the linkage comprising three points of connection, the points when linearly connected forming a triangle with the points of connection forming the apexes of the triangle, with:

(i) one apex of the triangle directed towards the hydraulic cylinders and piston rods between the upper and lower boom arms and the linkage being pivotally connected at this point of connection to the free ends of the cylinders or piston rods not connected to the arms;

(ii) another apex of the triangle proximate the upper arm being secured to the end of the upper arm proximate this point of connection;

and (iii) another apex of the triangle proximate the lower arm being pivotally secured to the end of the lower arm at this point of connection.

14 Claims, 11 Drawing Figures

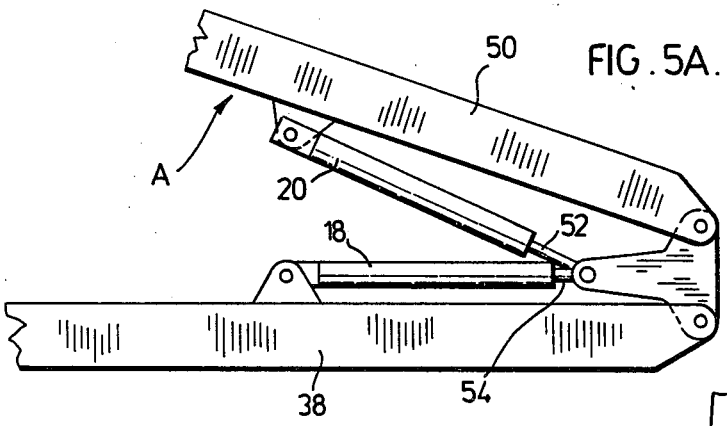
FIG. 5A.
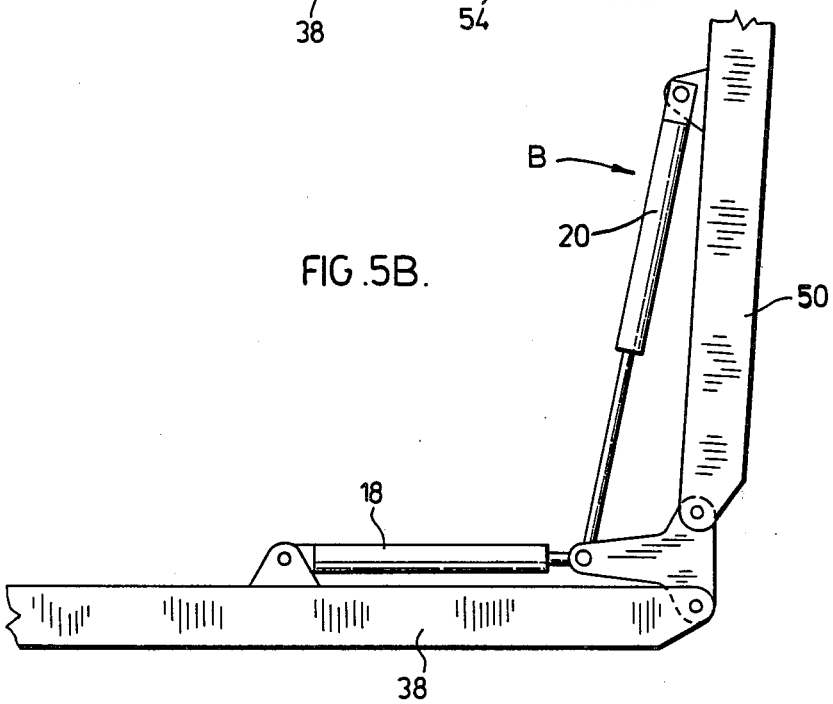
FIG. 5B.
FIG. 5C.
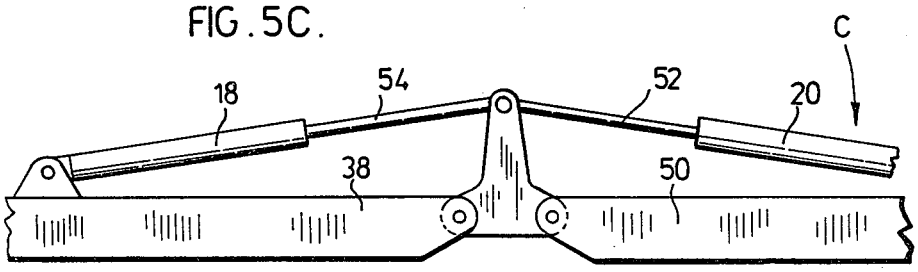

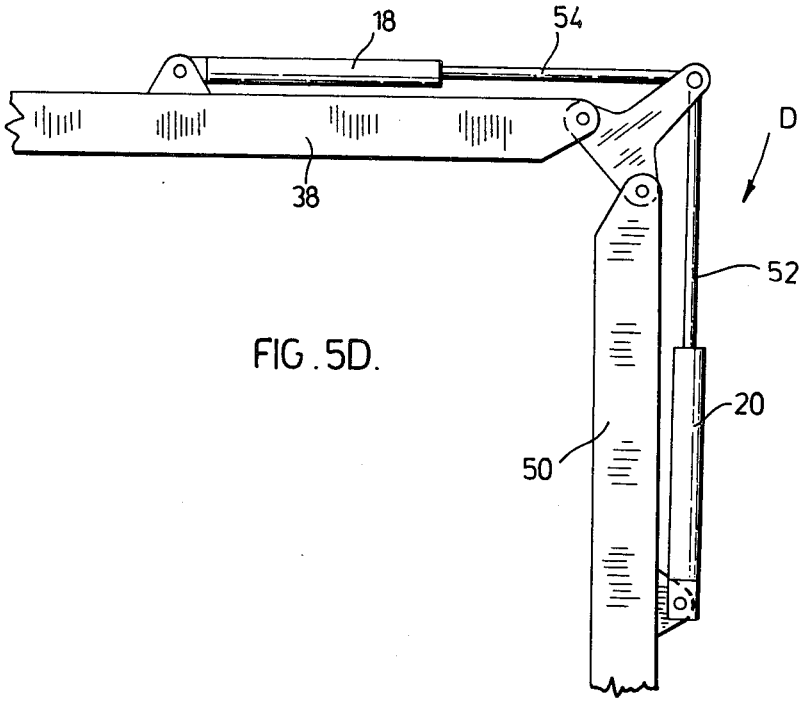
FIG. 5D.
FIG. 5E.
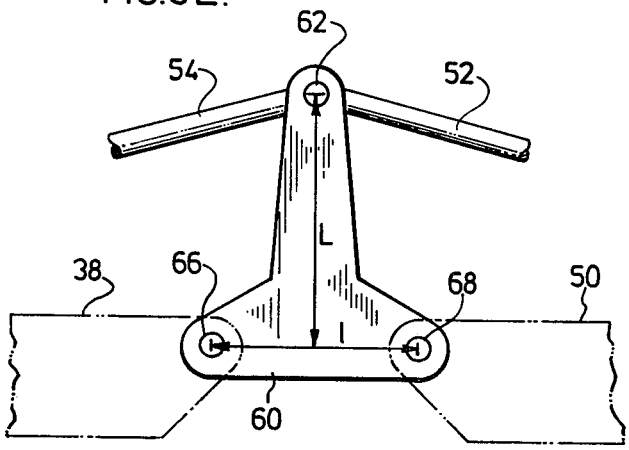

ARTICULATED BOOM AND ASSEMBLY THEREFOR

FIELD OF INVENTION

This invention relates to articulated booms and finds one particular application in truck mounted articulated booms secured at one end to the truck body and at the other to a work platform or bucket carrier.

BACKGROUND OF THE INVENTION

Articulated booms are well known in the art. See for example, U.S. Pat. Nos. 2,881,030; 2,940,539; 3,082,842 and 3,834,488. In operation, the upper arm is pivoted relative to the lower, which is itself pivotable, both to the desired positions. To maximize use capabilities, it is preferable that the boom have the capabilities of moving the arms through a vertically aligned co-linear position (centered position) to a vertically over-centered position. In an attempt to achieve maximum articulation, the prior art constructions provided individual hydraulic cylinders acting on the arms, pivoting on pins joining the arms, or employed cables or chains connected to the arms for relative movement of the arm. However, no articulated boom employing hydraulic cylinders and pin connection has provided relative rotation of the upper arm relative to the lower arm to exceed about 210°.

In an attempt to achieve a greater angular separation of the upper and lower arms the prior art articulated booms have employed chains or cables to rotate the upper arm relative to the lower arm. By employing chains or cables, angular separation of the two arms of about 270° has been achieved. However, the strength of the cables or chains employed used to rotate and secure the arms is only as great as the weakest link of the chain or weakest part of the cable. Since these articulated booms are employed to lift workers on work platforms, for example, to repair hydro or telephone lines, safety is paramount to requiring 100% reliability and consequently, this approach has not been widely accepted in the industry.

Additionally, the use of cables and chains requires cumbersome supporting assemblies and widely restricts maneuverability of the articulated boom.

It is therefore an object of this invention to provide an articulated boom and assembly useful therewith which overcomes the aforementioned difficulties with the prior art, permitting safe relative angular rotation between the lower and upper arms of about 270°.

Further and other objects of the invention will be realized by those skilled in the art from the summary of the invention and detailed description of preferred embodiments thereof.

SUMMARY OF THE INVENTION

According to one aspect of the invention, an articulated boom and assembly carrying a bucket or platform suitable for carrying a workman is provided, comprising:

(a) a lower boom arm;

(b) an upper boom arm foldable over the lower arm, pivotal with respect to the lower boom arm;

(c) hydraulic cylinders positioned between the boom arms and having piston rods extending therefrom, the hydraulic cylinders with the piston rods pivotally secured at one end to each boom arm intermediate the boom arm's ends, one hydraulic cylinder being pivotally secured to the underside of the upper arm and the other cylinder pivotally secured to the upperside of the lower arm facing the upperside when the upper arm is folded over the lower arm;

and (d) a linkage for pivotally connecting the upper arm, lower arm and hydraulic cylinders, the linkage comprising three points of connection, the points when linearly connected forming a triangle (preferably an isoceles triangle) and the points of connection are the apexes of the triangle with:

(i) one apex of the triangle (for example, in the case of the points of connection forming an isoceles triangle, the apex created by the meeting of the two equal sides), directed towards the hydraulic cylinders and piston rods between the upper and lower boom arms, and the linkage being pivotally connected at this point of connection to the free ends of the cylinders or piston rods not connected to the arms;

(ii) another apex of the triangle proximate the upper arm being pivotally secured to the end of the upper arm at this point of connection;

and (iii) another apex of the triangle proximate the lower arm being pivotally secured to the end of the lower arm at this point of connection, the distance between the apexes referred to in subparagraphs (ii) and (iii) being less than the vertical distance from the apex referred to in subparagraph (i) to the line joining the apexes referred to in subparagraphs (ii) and (iii), thus permitting the arms to be rotated approximately 270 degrees from one another.

According to another aspect of the invention, both the upper and lower arms may be about the same length.

According to another aspect of the invention, the linkage may be generally T-shaped in cross-section having a top and spine extending from the intermediate the ends of the top, with the point of connection forming an apex of the triangle (preferably an isoceles triangle) directed towards the hydraulic cylinders between the upper and lower boom arms being disposed on the spine extending from the top, and the top is oriented with the other points of connection forming the other apexes of the triangle situate proximate the ends of the top.

According to another aspect of the invention, a third arm may be pivotally secured to the end of the upper arm remote the arm end secured to the linkage to pivot at least about 90° relative to the upper arm.

The lower arm of the articulated boom may be lifted by a hydraulic cylinder to a vertical position as necessary. Therefore, the articulated boom and assembly may be truck mounted and used for example, for elevating workmen to repair telephone wires or transmission lines, but also, with the addition of the third arm, the articulated boom and assembly may be mounted on a vehicle and be used to permit workmen to inspect the underside of, for example, a bridge.

In operation, the two hydraulic cylinders between the upper and lower boom arms are connected to a common reservoir and activated by a common control system. Because the lower arm carries the weight of the upper arm (when initially folded thereon), the upper cylinder is the more effective when both cylinders are activated causing the upper arm to pivot on the linkage relative to the lower arm until the upper arm of the articulated boom rotates over 90° relative to the lower arm. At that moment, the load supported and carried by the lower arm is considerably reduced, permitting the hydraulic cylinder secured to the lower arm to operate more effectively. As the cylinder controlling movement of the upper arm reaches the end of its stroke, generally at about 135°, an equalization and transfer of power occurs to the hydraulic cylinder controlling the movement of the lower arm, thus causing the linkage to start to rotate permitting the upper arm to be positioned at angles of up to about 270° relative to the lower arm. At the extreme, and in instances where the lower arm has not been pivoted to an elevated position, the upper arm extends generally down and below the truck or vehicle mounting it and if a third arm is pivotally secured to the upper arm at the free end, and supports a work platform, the assembly becomes very useful for bridge inspection by positioning the third arm under the bridge.

The invention will now be illustrated with reference to the drawings, illustrating preferred embodiments of the invention and to the detailed description of the drawings.

BRIEF DESCRIPTION OF THE DRAWINGS

FIGS. 5A to 5D inclusive, illustrate individually the respective positions of the articulating boom and assembly shown in FIG. 4.

FIG. 5E is a schematic drawing illustrating the relationship between various points of the linkage used in the articulating boom and assembly shown in FIG. 1 to 4 inclusive.

DETAILED DESCRIPTION OF THE DRAWINGS

Figure 1:
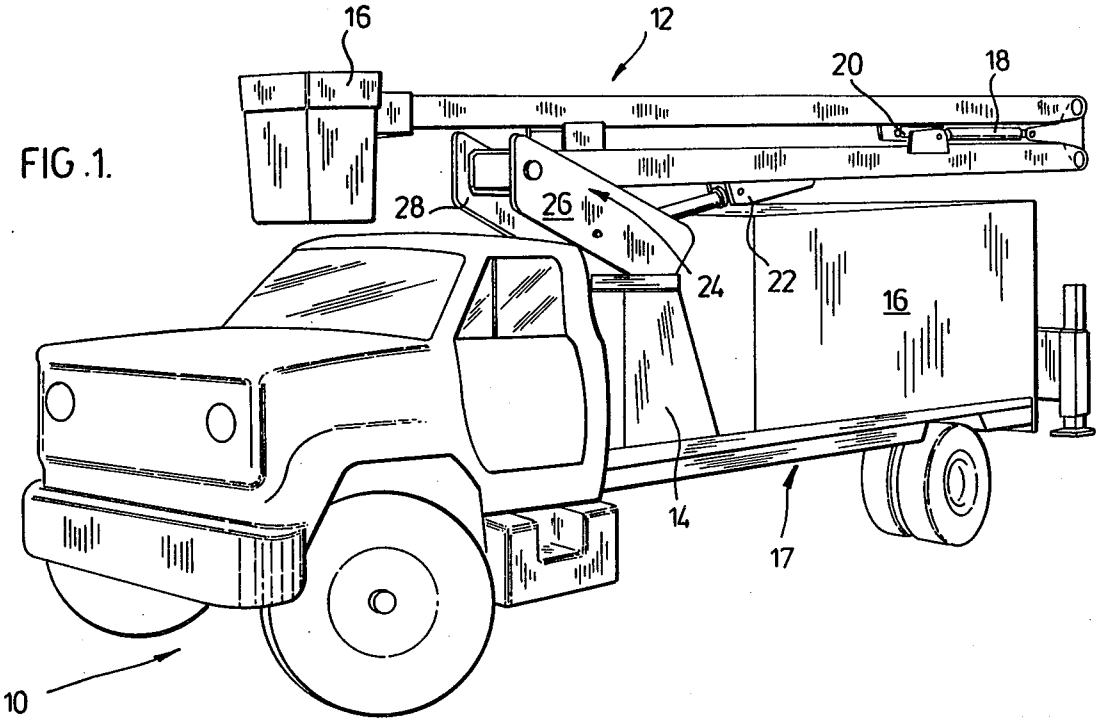
FIG. 1 is a close-up view of part of the articulated boom and assembly of FIGS. 1 and 2 partially disassembled.
Figure 2:
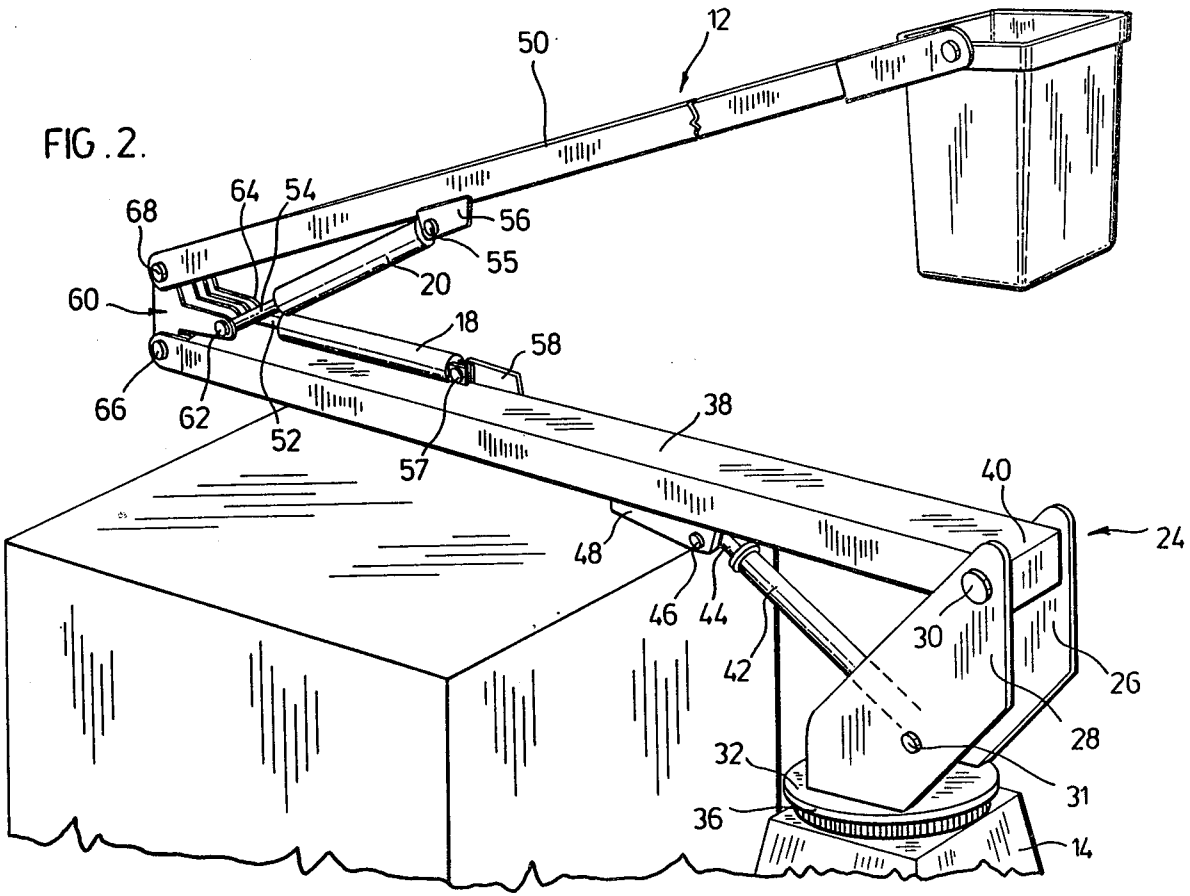
FIG. 2 is a close-up perspective view of the articulated boom and assembly partially unfolded shown in FIG. 1.
Figure 3:
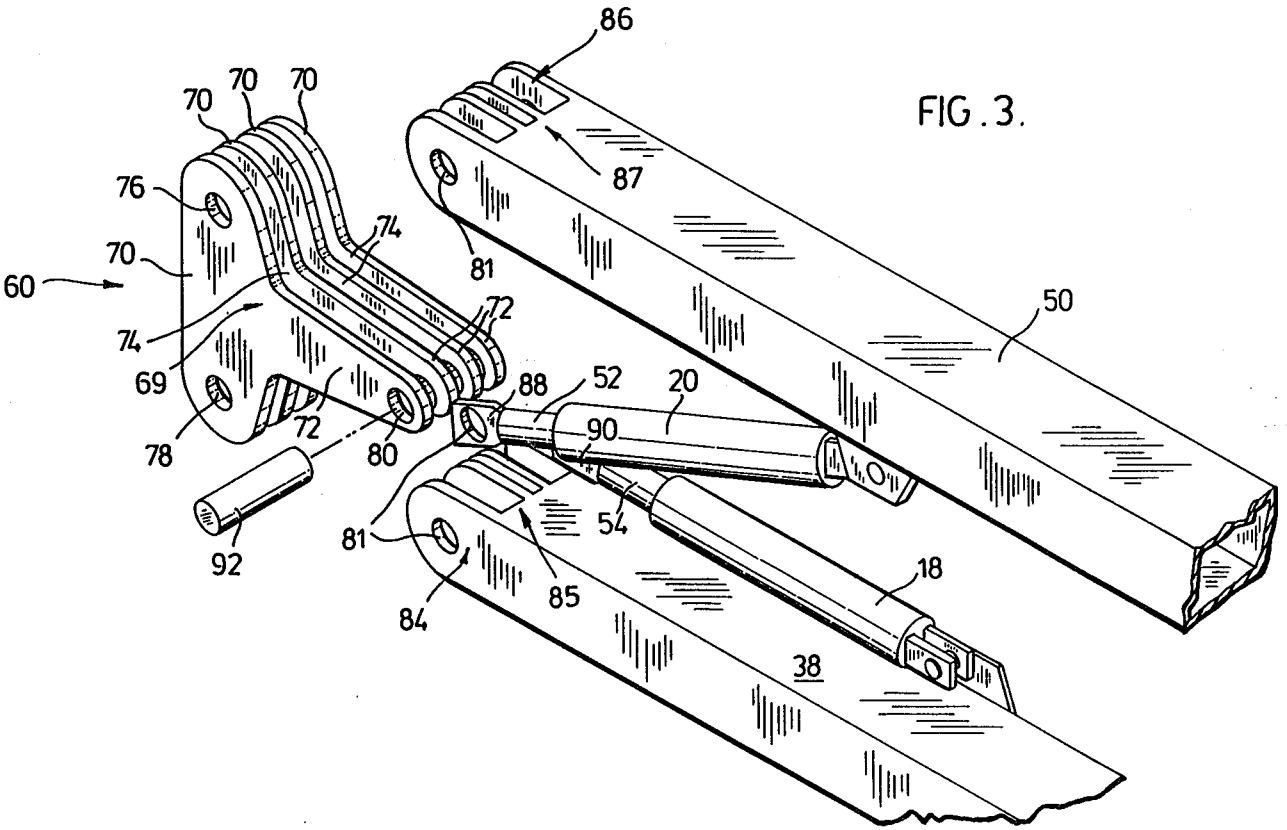
FIG. 3 is a close-up view of part of the articulated boom and assembly of FIGS. 1 and 2 partially disassembled.

With reference to FIG. 1, there is shown truck 10 mounting articulated boom and assembly 12 supported on pedestal 14 to carry work bucket 16 for carrying a person to work to sites remote the truck. Truck 10 carries equipment housing 16 on trailer 17 for housing the control equipment and hydraulic equipment (including reservoir, pumps, controls and circuitry leading to and from the hydraulic cylinders employed, 18, 20 and 22).

Pedestal 14 carries frame 24 comprising two spaced plates 26 and 28 spaced by cylindrical pins 30 and 31. Frame 24 is secured at 32 and 34 to rotatable platform 36 secured to rotate over stationary pedestal 14.

Articulated boom and assembly 12 and incidental components comprise:

(a) lower boom arm 38 pivotably secured at end 40 on pin 30 to frame 24 to be raised and lowered by hydraulic cylinder 42 having piston rod 44 reciprocal therein, cylinder 42 being secured on pin 31 for relative rotation with respect thereto and piston rod on axle 46 secured to frame 48 on the underside of arm 38, for relative rotation with respect thereto;

(b) upper boom arm 50 secured to, and folded over, lower arm 38 and pivotal with respect thereto;

(c) hydraulic cylinders 18 and 20 positioned between the boom arms, having piston rods 52 and 54 extending therefrom respectively, hydraulic cylinder 18 pivotally secured at one end by pin 55 to plate 56 on the underside of upper arm 50 and cylinder 20 pivotally secured at one end by pin 57 to plate 58 on the top of lower arm 38; and (d) T-shaped linkage 60 comprising four spaced plates 69, each plate 69 having a top portion 70 and depending spines 72 extending from top portion 70 intermediate their sides edges joined together (not shown) to provide three channels 74.

Aligned bores 76, 78 and 80 are provided through T-shaped linkage 60 proximate the extremities (side edges of portions 70 and end of spines 72) of T-shaped linkage 60 for pivotally securing hydraulic cylinders 18 and 20, (piston rods 52 and 54 are each pivotally secured to T-shaped linkage 60 at 62 and 64 respectively by pin 92 passing through bore 80 and plates 88 and 90 on the ends of piston rods 52 and 54) and upper and lower arms 50 and 38 respectively to linkage 60 at 66 and 68 respectively by pins, as for example, by a pin passing through bores 76 and 78 and bores 81 aligned with bores 76 and 78 through series of spaced connecting plates 84 and 86 of connectors 85 and 87 extending from the ends of arms 38 and 50 respectively, for meshing with spaced T-shaped plates 69 of T-shaped linkage 60. Therefore, plates 88 and 90 of piston rods 52 and 54 are secured in the spaces 74 between spines 78 of linkage 60 by pin 92 passing through bores 80 and the holes through plates 88 and 90 and plates 84 and 86 are meshed with plates 64 and secured in the spaces 74 between plate portions 70 of linkage 60 by pins (not shown) passing through bores 76 and 78 and aligned bores in plates 84 and 86.

Figure 4:
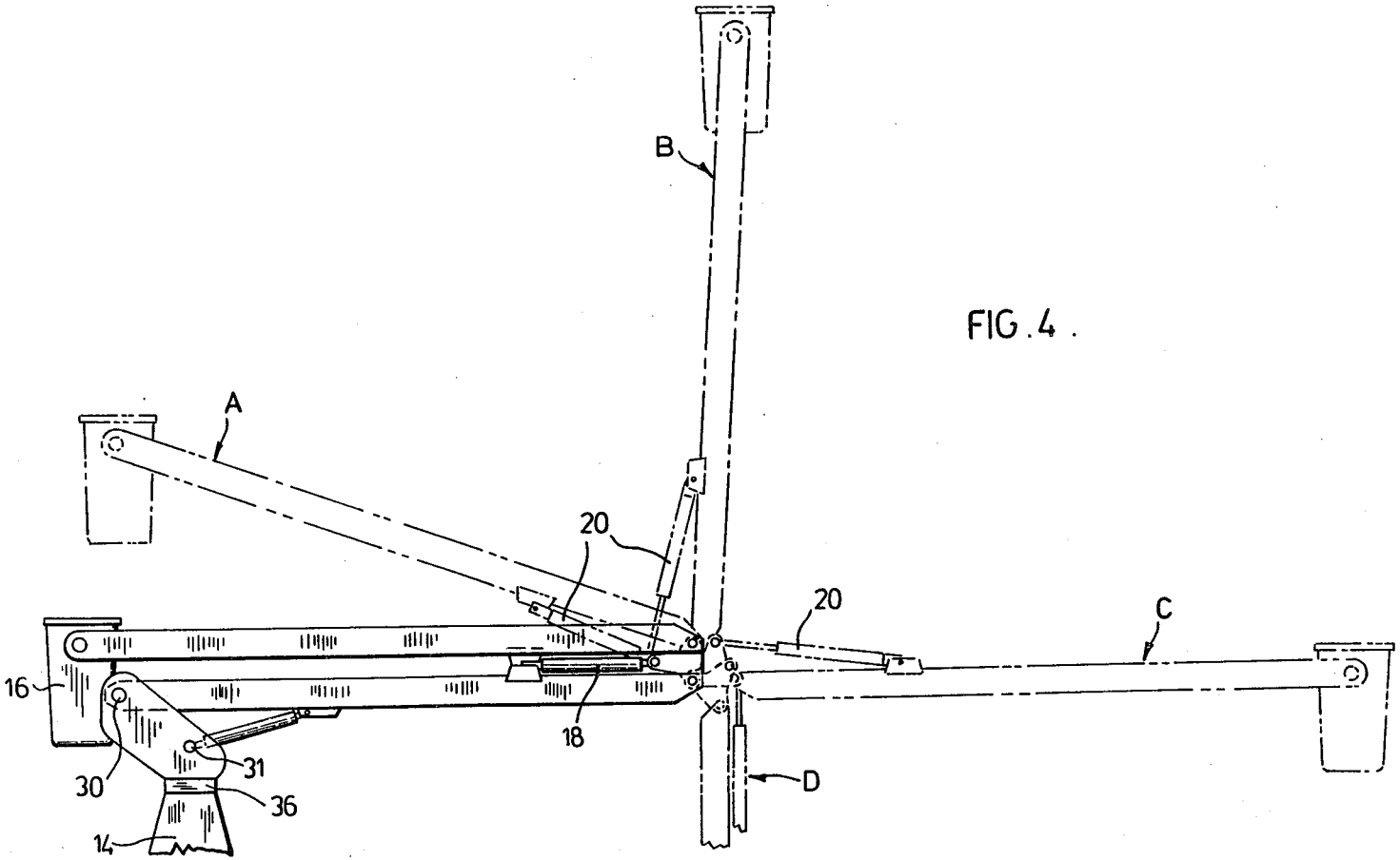
FIG. 4 illustrates various positions of the articulated boom and assembly during one mode of operation.

With reference to FIG. 4, the rotation only of the upper arm 50 relative to the stationary lower arm 38 of the articulated boom is illustrated without regard to the elevation of lower arm 38 by hydraulic cylinder 42.

As the hydraulic cylinders 18 and 20 are connected to a common reservoir and activated by a common structural system, when hydraulic fluid is fed to cylinder 18, fluid is also fed to cylinder 20. However, because lower arm 38 initially carries the additional weight of the upper arm 50, cylinder 20 is the only cylinder initially effectively activated. Therefore, initially rod 54 of cylinder 20 is pushed against linkage 60, elevating and rotating upper arm 50 relative to linkage 60 and arm 38 (See A of FIGS. 4 and 5) until upper arm 50 rotates over-center. (See B of FIGS. 4 and 5). At that moment, the load supported and carried by lower arm 38 is considerably reduced, permitting hydraulic cylinder 18 to operate more effectively and begin to rotate linkage 60 after cylinder 20 has completed its stroke (when upper arm 50 forms an angle of about 135° to lower arm 38). At that point, an equalization and transfer of power occurs allowing cylinder 18 to rotate linkage 60 by extension of piston rod 54 to pivot upper arm 50 safely through position C to position D of FIGS. 4 and 5. To fold the assembly, the cylinders are operated to reverse the sequence of the steps. With reference to FIG. 5E, the relationship between the distance (1) between point 66 and point 68 on the linkage 60 (shown as a T) and the vertical distance (L) from point 62 to the line joining point 66 and point 68 (1) is shown. Length "L" is longer than length "l" between points 66 and 68.

For elevating arm 38 relative to truck 10, cylinder 42 is activated causing rod 44 to push arm 38 away from cylinder 42.

Figure 6:
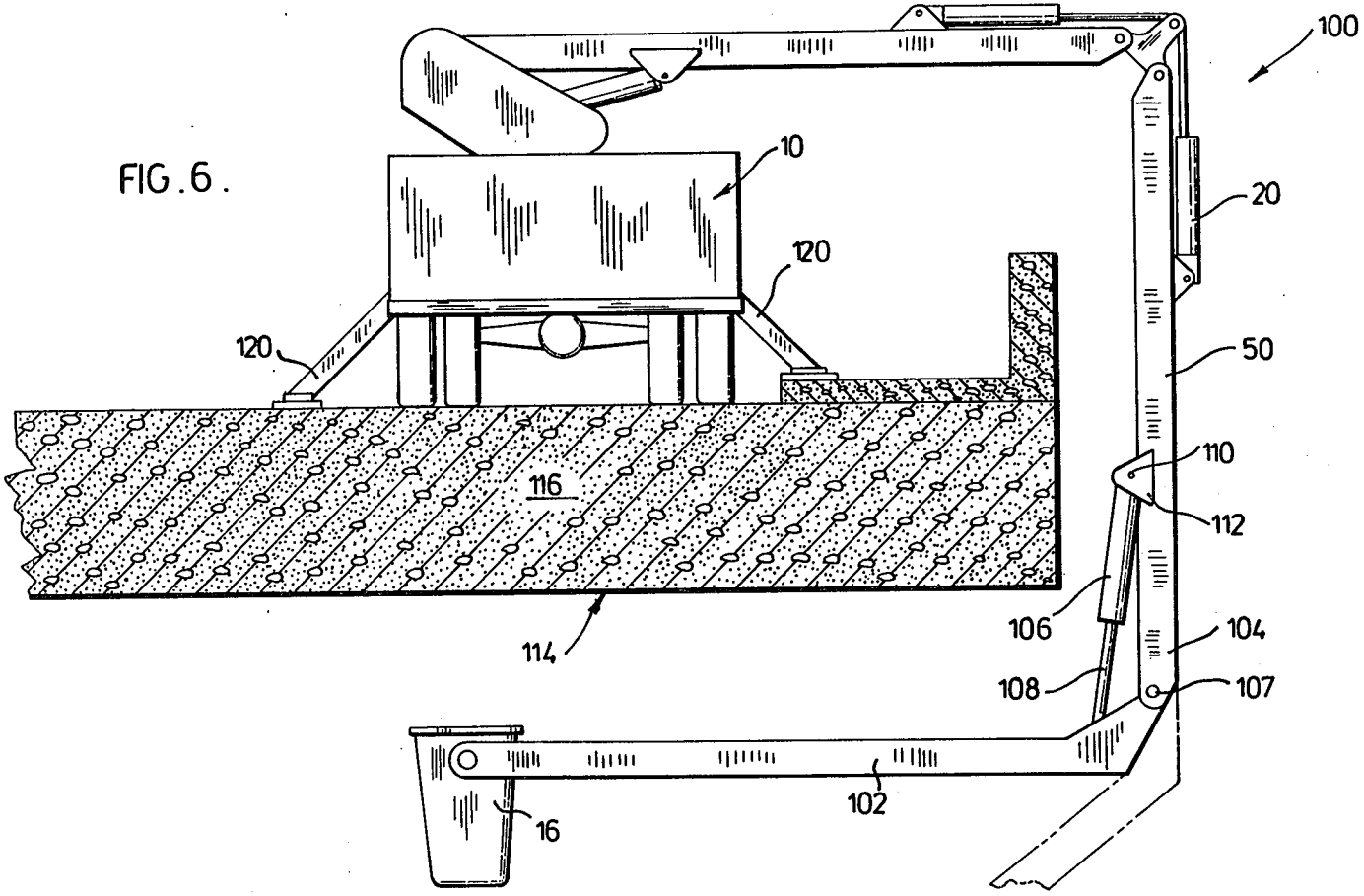
FIG. 6 is a rear view of a truck mounting an articulated boom and assembly according to a second preferred embodiment of the invention.
Figure 7:
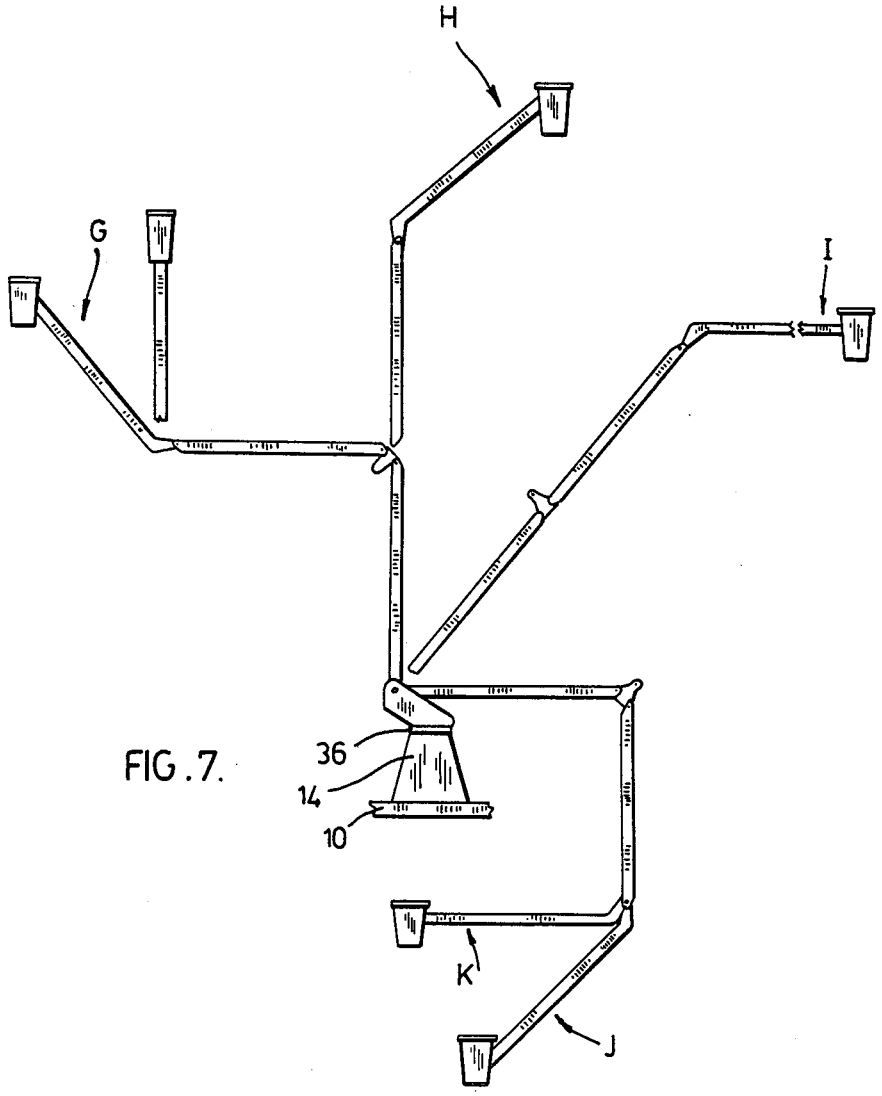
FIG. 7 is a schematic of one mode of operation of the articulated boom and assembly shown in FIG. 6.

With reference to FIGS. 6 and 7, there is shown an articulated boom and assembly 100 mounted for use for bridge inspection. Articulated boom and assembly 100 are substantially of the same construction as articulated boom and assembly 12 previously described except for the interposition of:

(a) pivotal arm 102, pivotal on pin 107 on end 104 of arm 50 between arm 50 and work bucket 16; and (b) hydraulic cylinder 106 secured intermediate the other end of arm 50, on the side of arm 50, remote cylinder 20. Reciprocal piston rod 108 extends from one end of hydraulic cylinder 106 and is pivotally secured to arm 102. The other end of hydraulic cylinder 106 is pivotally secured on pin 110 secured between spaced plates one of which being shown at 112. As can be seen, in FIG. 6, articulated boom and assembly 12 and additional hydraulically controlled pivotable arm 102 has been fully extended (by controls—not shown) for inspection of the underside 114 of bridge 116.

Truck 10 has been stabilized by outrigger stabilizers 120 extending from the sides of truck 10 to permit rotation of the assembly on rotatable platform 36 to position boom and assembly 110 transverse the longitudinal axis of the truck to be unfolded in the inspection position. For the purposes of unfolding the entire assembly, arms 38, 50 and 102 are unfolded to position G shown in FIG. 7. The unfolded structure is then moved through positions H, I, and J to inspection position K under bridge 116.

As many changes can be made to the embodiments hereinbefore described without departing from the scope of the invention, it is intended that all matter contained herein be interpreted as illustrative of the invention and not in a limiting sense.

The embodiments of the invention in which an exclusive property or privilege is claimed are as follows:

1. An articulated boom and assembly for carrying a bucket or platform suitable for carrying a person, comprising:

(a) a lower boom arm;

(b) an upper boom arm foldable over the lower boom arm and pivotal with respect to the lower boom arm;

(c) hydraulic cylinders positioned between the boom arms and having piston rods extending therefrom, the hydraulic cylinders with the piston rods, pivotally secured at one end to each boom arm intermediate the boom arm's ends, one hydraulic cylinder being pivotally secured to the underside of the upper arm and the other cylinder pivotally secured to the upper side of the lower arm facing the upper side when the upper arm is folded over the lower arm;

(d) a linkage for pivotally connecting the upper arm, lower arm and hydraulic cylinders, the linkage comprising three points of connection, the points when linearly connected forming a triangle with the points of connection forming the apexes of the triangle, with:

(i) one apex of the triangle directed towards the hydraulic cylinders and piston rods between the upper and lower boom arms and the linkage being pivotally connected at this point of connection to the free ends of the cylinders of piston rods not connected to the arms;

(ii) another apex of the triangle proximate the upper arm being secured to the end of the upper arm proximate this point of connection; and (iii) another apex of the triangle proximate the lower arm being pivotally secured to the end of the lower arm at this point of connection, the distance between the apexes referred to in subparagraphs (ii) and (iii) being less than the vertical distance from the apex referred to in subparagraph (i) to the line joining the apexes referred to in subparagraphs (ii) and (iii) thus permitting the arms to be rotated approximately 270 degrees from one another.

2. The combination of claim 1, wherein the three points of connection on th linkage form an isoceles triangle, with the apex of the triangle created by the meeting of the two equal sides being directed towards the hydraulic cylinders and piston rods between the upper and lower boom arms.

3. The combination of claim 1, wherein the linkage is generally T-shaped in cross-section having a top and spine extending therefrom intermediate the ends of the top with the apex of the triangle formed by the points of connection directed towards the hydraulic cylinders between the upper and lower arms being disposed on the spine remote the top and the other apexes forming points of connection are disposed on the top proximate the ends of the top.

4. The combination of claim 2, wherein the linkage is generally T-shaped in cross-section having a top and spine extending therefrom intermediate the ends of the top with the apex of the triangle formed by the points of connection directed towards the hydraulic cylinders between the upper and lower arms being disposed on the spine remote the top and the other apexes forming points of connection are disposed on the top proximate the ends of the top.

5. The combination of claim 1, wherein both the upper and lower arms are of about equal length.

6. The combination of claim 2, wherein both the upper and lower arms are of about equal length.

7. The combination of claim 3, wherein both the upper and lower arms are of about equal length.

8. The combination of claim 4, wherein both the upper and lower arms are of about equal length.

9. The combination of claim 3, wherein the T-shaped linkage in cross-section comprises a plurality of T-shaped plates spaced from one another and the ends of the arms connected thereto comprise spaced plates to mesh with the spaced T-shaped plates and the meshed plates are secured thereto.

10. The combination of claim 4, wherein the T-shaped linkage in cross-section comprises a plurality of T-shaped plates spaced from one another and the ends of the arms connected thereto comprise spaced plates to mesh with the spaced T-shaped plates and the meshed plates are secured thereto.

11. The combination of claim 1 or 2, further comprising a third arm pivotally secured to the end of the upper arm remote the arm end secured to the linkage to pivot at least about 90° relative to the upper arm and a hydraulic cylinder secured to pivot the third arm to its operating position.

12. The combination of claim 3 or 4, further comprising a third arm pivotally secured to the end of the upper arm remote the arm end secured to the linkage to pivot at least about 90° relative to the upper arm and a hydraulic cylinder secured to pivot the third arm to its operating position.

13. The combination of claim 5 or 6, further comprising a third arm pivotally secured to the end of the upper arm remote the arm end secured to the linkage to pivot at least about 90° relative to the upper arm and a hydraulic cylinder secured to pivot the third arm to its operating position.

14. The combination of claim 7 or 8, further comprising a third arm pivotally secured to the end of the upper arm remote the arm end secured to the linkage to pivot at least about 90° relative to the upper arm and a hydraulic cylinder secured to pivot the third arm to its operating position.

* * * * *

UNITED STATES PATENT AND TRADEMARK OFFICE

CERTIFICATE OF CORRECTION

PATENT NO. : 4,461,369

DATED : July 24, 1984

INVENTOR(S) : Joseph Amador

It is certified that error appears in the above-identified patent and that said Letters Patent is hereby corrected as shown below:

At column 5, line 23, after 'assembly' and before 'and additional', the number "12" should be replaced with --100--.

At column 5, line 30, after 'assembly' and before 'transverse', the number "110" should be replaced with --100--.

At column 6, line 18, after 'on' and before 'linkage', "th" should be corrected to read --the--.

Signed and Sealed this

Thirty-first Day of January, 1989

*Attest:*

DONALD J. QUIGG

*Attesting Officer*

*Commissioner of Patents and Trademarks*